US009799255B2

(12) United States Patent
Won et al.

(10) Patent No.: US 9,799,255 B2
(45) Date of Patent: Oct. 24, 2017

(54) DISPLAY DEVICE AND METHOD OF DRIVING THE SAME

(71) Applicant: SAMSUNG DISPLAY CO., LTD., Yongin-si, Gyeonggi-do (KR)

(72) Inventors: Byeong Hee Won, Yongin-si (KR); Jong In Baek, Yongin-si (KR); Rang Kyun Mok, Yongin-si (KR); Won Sang Park, Yongin-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 0 days.

(21) Appl. No.: 15/427,841

(22) Filed: Feb. 8, 2017

(65) Prior Publication Data

US 2017/0148368 A1 May 25, 2017

(30) Foreign Application Priority Data

Nov. 10, 2014 (KR) ..... 10-2014-0155370

(51) Int. Cl.
*G09G 3/20* (2006.01)

(52) U.S. Cl.
CPC ..... *G09G 3/2003* (2013.01); *G09G 3/2007* (2013.01); *G09G 3/2092* (2013.01); *G09G 2300/0452* (2013.01); *G09G 2320/0242* (2013.01); *G09G 2340/0428* (2013.01)

(58) Field of Classification Search
CPC .. G09G 3/2092; G09G 3/2003; G09G 3/2007; G09G 2320/0242
See application file for complete search history.

(56) References Cited

U.S. PATENT DOCUMENTS

| | | | | |
|---|---|---|---|---|
| 9,569,998 | B2 * | 2/2017 | Won | G09G 3/2092 |
| 2006/0227092 | A1 * | 10/2006 | Nose | G09G 3/2092 345/98 |
| 2009/0160882 | A1 * | 6/2009 | Kiya | G09G 3/2007 345/690 |
| 2015/0070406 | A1 | 3/2015 | Baek et al. | |
| 2015/0177438 | A1 * | 6/2015 | Drolet | G02B 6/0035 349/65 |
| 2015/0187094 | A1 | 7/2015 | Lee et al. | |

FOREIGN PATENT DOCUMENTS

| | | | |
|---|---|---|---|
| KR | 10-2003-0031207 | A | 4/2003 |
| KR | 10-2003-0086397 | A | 11/2003 |
| KR | 10-2005-0054244 | A | 6/2005 |
| KR | 10-2012-0052739 | A | 5/2012 |
| KR | 10-2013-0026628 | A | 3/2013 |

* cited by examiner

*Primary Examiner* — Abbas Abdulselam
(74) *Attorney, Agent, or Firm* — Lee & Morse P.C.

(57) ABSTRACT

A display device includes a signal receiver, a signal generator, and a signal corrector. The signal receiver receives an image signal. The signal generator generates a data signal for each of a first color pixel and a second color pixel based on the image signal. The signal corrector generates corrected data for the first color pixel based on the data signal for the second color pixel in a single driving mode. The first color pixel and the second color pixel emit light of different grayscale values of a same color. The first color pixel is driven and the second color pixel is not driven in the single driving mode.

33 Claims, 8 Drawing Sheets

DISPLAY DEVICE AND METHOD OF DRIVING THE SAME

CROSS-REFERENCE TO RELATED APPLICATIONS

This is a continuation application based on pending application Ser. No. 14/644,561, filed Mar. 11, 2015, the entire contents of which is hereby incorporated by reference.

Korean Patent Application No. 10-2014-0155370, filed on Nov. 10, 2014, and entitled, "Display Device and Method of Driving the Same," is incorporated by reference herein in its entirety.

BACKGROUND

1. Field

One or more embodiments described herein relate to a display device and a method of driving a display device.

2. Description of the Related Art

A flat panel display (FPD) has a plurality of pixels for displaying images. Each pixel may include a red subpixel, a green subpixel, and a blue subpixel. Each of the subpixels are controlled based on data from an external source. The pixels may be arranged in various ways, such as a stripe structure, a mosaic structure, or a delta structure. In a mosaic structure, red, green, and blue subpixels are sequentially arranged in column and row directions. In a delta structure, pixels are alternately arranged in a zigzag pattern in the column direction, and red, green and blue subpixels are sequentially arranged.

One type of pixel arrangement having a PenTile structure may better express high resolution and, at the same time, may have reduced design cost. In a PenTile structure, red subpixels and blue subpixels are alternately formed in the same column, and green subpixels are formed in an adjacent column. The PenTile matrix structure reduces the numbers of red subpixels and blue subpixels by half, compared with the stripe structure. Accordingly, the total number of pixels is reduced to 2/3 compared with the stripe structure. This may result in a higher aperture ratio. In addition, the same perceived resolution as the stripe structure may be obtained through rendering driving.

Research has determined that blue light emitted from a display panel reduces the amount of melatonin produced in the human body. Melatonin is a hormone involved in biorhythms such as circadian and circannual rhythms by sensing a change in photoperiod, such as a change in sunshine duration according to the length of night or day or a seasonal change in sunshine duration. If a person is exposed to a large amount of blue light at night, his or her biorhythm may be broken, causing problems (such as meal time, perception of night and day and sleeping hours) with his or her body.

In attempt to solve these side effects, blue light (i.e., a unit color) of a display device may be divided into first blue light which is relatively highly efficient and second blue light which is relatively less efficient. Then, the first blue light may be used in the daytime, and the second blue light may be used at night. Since the blue light used varies according to the time of the day when the display device is used, the effect of blue light on the human body may be reduced.

However, the number of pixels being driven is limited in a single driving mode (in which any one of the first blue light or the second blue light is driven) compared with a mixed driving mode (in which both the first blue light and the second blue light are driven). Therefore, the single driving mode reduces resolution, thus degrading display quality.

SUMMARY

In accordance with one embodiment, a display device includes a signal receiver to receive an image signal; a signal generator to generate a data signal for each of a first color pixel and a second color pixel based on the image signal; and a signal corrector to generate corrected data for the first color pixel based on the data signal for the second color pixel in a single driving mode, wherein first color pixel and the second color pixel are to emit light of different grayscale values of a same color and wherein the first color pixel is to be driven and the second color pixel is not to be driven in the single driving mode.

The plurality of the first color pixels may be adjacent to the second color pixel, and the signal corrector may generate corrected data for each of the plurality of first color pixels adjacent to the second color pixel, the corrected data for each of the plurality of first color pixels may be generated based on the data signal for the second color pixel. The signal corrector may generate the corrected data by correcting the data signal of each of the plurality of first color pixels to a substantially equal level.

The plurality of first color pixels may include four of the first color pixels adjacent to the second color pixel. The first color pixels may be separated from the second color pixel by substantially equal distances. Each the plurality of first color pixels may be located in a diagonal direction relative to the second color pixel. Each of the plurality of first color pixels may be in a horizontal or vertical direction relative to the second color pixel.

The signal corrector may calculate a luminance change value of the second color pixel, calculate a corrected gray value of the first color pixel based on the luminance change value, and generate the corrected data based on the corrected gray value of the first color pixel.

The signal corrector may calculate a luminance change value of the first color pixel and a luminance change value of the second color pixel, calculate a corrected gray value of the first color pixel based on the luminance change value of the first color pixel and the luminance change value of the second color pixel, and generate the corrected data based on the corrected gray value of the first color pixel. The first color pixel may emit light having a center wavelength in a range of 440 to 458 nm, and the second color may emit light having a center wavelength in a range of 459 to 480 nm.

In accordance with another embodiment, a method for driving a display device includes generating a data signal for a first color pixel and a data signal for a second color pixel based on an image signal; and generating corrected data for the first color pixel based on the data signal for the second color pixel when the display device is in a single driving mode, wherein the first color pixel and the second color pixel are to emit light of different grayscale values of a same color and wherein the first color pixel is to be driven and the second color is not to be driven in the single driving mode. A plurality of first color pixels may be adjacent to the second color pixel, and generating the corrected data may include generating the corrected data for the plurality of first color pixels based on the data signal for the second color pixel.

Generating the corrected data may include correcting the data signal for each of the plurality of first color pixels to a substantially equal level. Generating the corrected data may include calculating a luminance change value of the second color pixel; calculating a corrected gray value of the first color pixel based on the luminance change value; and generating the corrected data based on the corrected gray value of the first color pixel. Generating the corrected data may include calculating a luminance change value of the first color pixel and a luminance change value of the second color pixel; calculating a corrected gray value of the first color pixel based on the luminance change value of the first color pixel and the luminance change value of the second color pixel; and generating the corrected data based on the corrected gray value of the first color pixel.

In accordance with another embodiment, a signal corrector for a display device includes first logic to receive a data signal for a first color pixel and a data signal for a second color pixel; and second logic to generate corrected data for the first color pixel based on the data signal for the second color pixel in a single driving mode, wherein first color pixel and the second color pixel are to emit light of different grayscale values of a same color and wherein the first color pixel is to be driven and the second color pixel is not to be driven in the single driving mode.

A plurality of first color pixel may be adjacent the second color pixel, and the second logic may generate corrected data for each of the plurality of first color pixels based on the data signal for the second color pixel. The second logic may correct the data signal for each of the plurality of first color pixels to a substantially same level. The first color pixels may be separated from the second color pixel by substantially equal distances. The same color may be blue.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
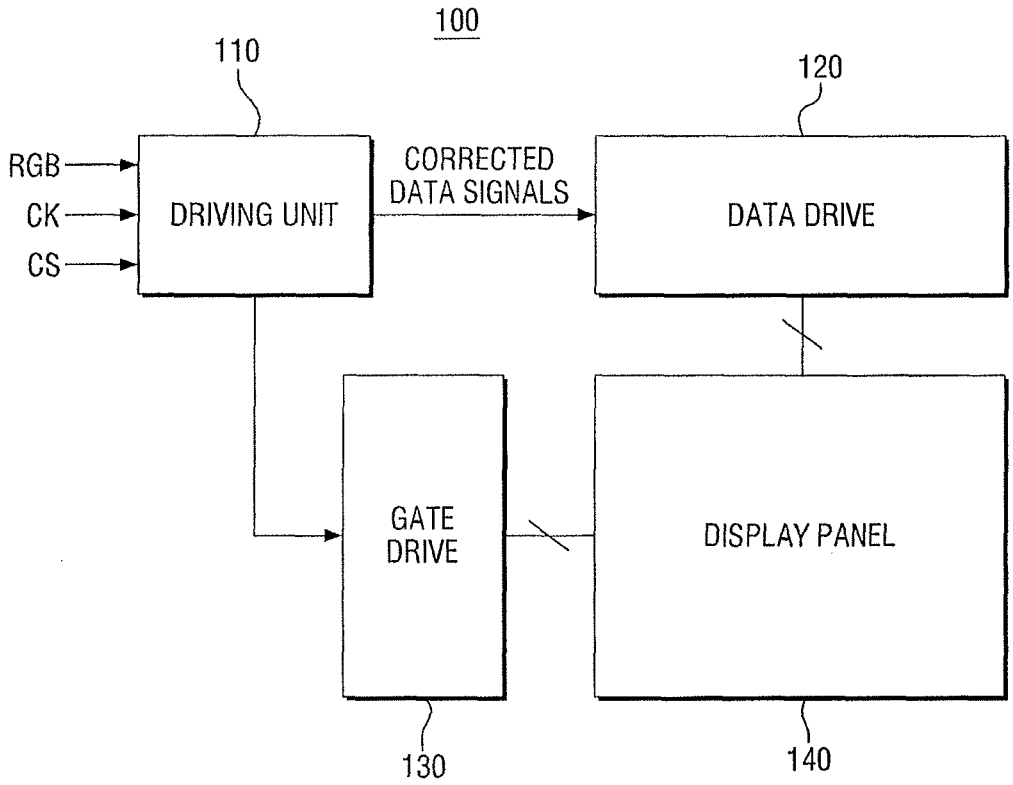
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

It will be understood that when an element or layer is referred to as being "on," or "connected to" another element or layer, it can be directly on or connected to the other element or layer or intervening elements or layers may be present. In contrast, when an element is referred to as being "directly on" or "directly connected to" another element or layer, there are no intervening elements or layers present. As used herein, the term "and/or" includes any and all combinations of one or more of the associated listed items.

One or more embodiments described herein relate to a display device having a unit color divided into a first color and a second color, and a method for driving such a display device. In one embodiment, unit colors may correspond to primary colors of light of pixels for displaying an image. The unit colors may be, for example, red, green and blue. The colors may be different in other embodiments. In addition, one or more unit colors may be divided into multiple colors. For example, a unit color may be divided into two colors or three colors. However, the present invention is not limited thereto.

FIG. 1 illustrates an embodiment of a display device 100 which includes a driving unit 110, a data drive 120, a gate drive 130, and a display panel 140. The display device 100 may be, for example, a liquid crystal display (LCD), an organic light-emitting diode display (OLED), a plasma display panel (PDP), or another type of display device. The pixels may be arranged in a PenTile pattern or another type of pattern.

The driving unit 110 generates data signals and gate signals based on an image signal (e.g., RGB), a clock signal CK, and a control signal CS received. for example, from an external source and according to a pixel arrangement and operating conditions of the display panel 140. The data signals are transmitted to the data drive 120. The data drive 120 outputs gray voltages for driving respective data lines connected to individual pixels based on the data signals. The gate signals are transmitted to the gate drive 130, and the gate drive 130 drives gate lines based on the gate signals.

In one embodiment, the display device 100 uses a unit color divided into two colors. In this case, the display device 100 may be operated in a mixed driving mode (in which the two colors of the unit color are all driven) or a single driving mode (in which any one of the two colors is driven). For example, if a unit color is divided into a first color and a second color, the driving unit 110 may drive all of first color pixels and second color pixels in the mixed driving mode, and may drive the first color pixels or the second color pixels in the single driving mode.

When the display device 100 is operated in the single driving mode for driving the first color pixels only, the driving unit 110 may correct data signals for the first color pixels based on data signals for the second color pixels. For example, the driving unit 110 may generate corrected data signals for the first color pixels based on the data signals for the second color pixels. This correction makes it possible to provide a similar resolution, which may be obtained by driving all of the first and second color pixels, by driving only the first color pixels. Therefore, the single driving mode with correction may improve display quality compared with the single driving mode without correction.

Figure 2:
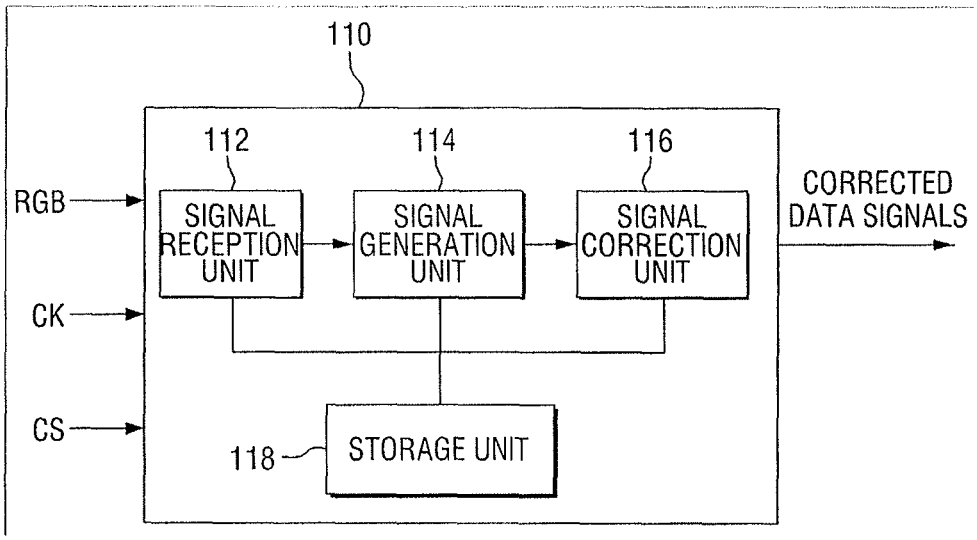
FIG. 2 illustrates an embodiment of a display driver.

FIG. 2 illustrates an embodiment of a driving unit, which, for example, may correspond to driving unit 110 of the display device 100 of FIG. 1. Referring to FIG. 2, the driving unit 110 includes a signal reception unit 112, a signal generation unit 114, a signal correction unit 116, and a storage unit 118.

The signal reception unit 112 may receive the image signal RGB, the clock signal CK, and the control signal CS from an external source. The image signal RGB may include luminance, gray, and color information of an image to be displayed on the display panel 140. The clock signal CK is a signal indicating the signal transmission timing of each of the data drive 120 and the gate drive 130. The clock signal CK may be a pulse signal in a predetermined form. The control signal CS may control display of an image. For example, the control signal CS may include a vertical/horizontal synchronization signal and a data enable signal. In another embodiment, a different combination of control signals may be used.

Based on the image signal RGB, the signal generation unit 114 generates data signals for a plurality of pixels in the display panel 140. The data signals may include gray voltage information for driving the data lines connected to individual pixels. For example, the display device 100 may use, as unit colors, a first color, a second color, and a third color divided into a (3-1)th color and a (3-2)th color. In this case, the signal generation unit 114 may generate a data signal for each of a plurality of first color pixels, a plurality of second color pixels, a plurality of (3-1)th color pixels, and a plurality of (3-2)th color pixels in the display panel 140.

In the single driving mode, the signal correction unit 116 corrects data signals, for pixels driven among pixels of two colors of a unit color, based on data signals for pixels not being driven. This correction may be performed, for example, to change gray information in each of the data signals for the pixels being driven.

The storage unit 118 may store information to be used for operating the driving unit 110. For rapid correction of data signals by the signal correction unit 116, the storage unit 116 may store information about a luminance ratio of two colors into which a unit color is divided, maximum luminances of pixels of the two colors, and the arrangement of the pixels of the two colors, and a driving mode.

Figure 3:
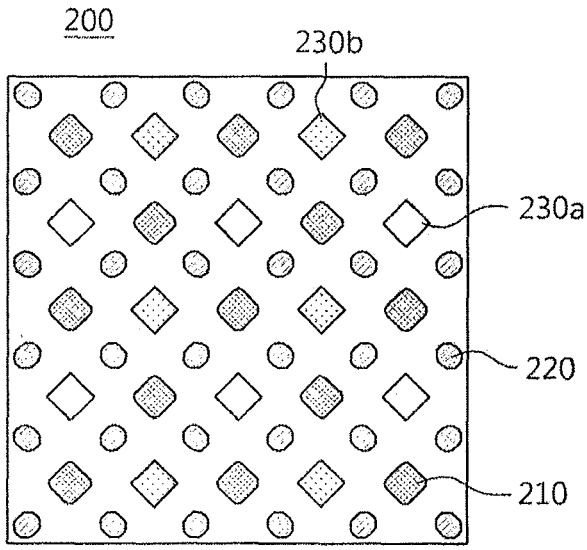
FIG. 3 illustrates an embodiment of a pixel arrangement.

FIG. 3 illustrates an embodiment of a pixel arrangement of a display device 200. Referring to FIG. 3, the display device 200 uses the unit colors of red, green, and blue, divided into deep blue and sky blue. In this case, a plurality of red pixels 210, a plurality of green pixels 220, a plurality of deep blue pixels 230*a*, and a plurality of sky blue pixels 230*b* may be arranged in the display panel 140 as in FIG. 3. In another embodiment, the red or green color pixel (e.g., one other than the blue pixel) may be divided into a plurality of (e.g., two or more) different colors, e.g., different gray-scale levels of the red or green color.

In this example, the red pixels 210, the deep blue pixels 230*a*, and the sky blue pixels 230*b* are arranged in the same row and column of the display panel 140. The red pixels 210 and the deep blue pixels 230*a* or the sky blue pixels 230*b* may be alternately arranged in any one row or column. The deep blue pixels 230*a* and the sky blue pixels 230*b* may be arranged diagonal to each other. In addition, the green pixels 220 may be arranged in a different row and column from the red pixels 210 and the deep blue and sky blue pixels 230*a* and 230*b*. A different pixel arrangement may be used in another embodiment. Also, in one embodiment, deep blue may have a center wavelength of 440 to 458 nm, and sky blue may have a center wavelength of 459 to 480 nm.

Figure 4:
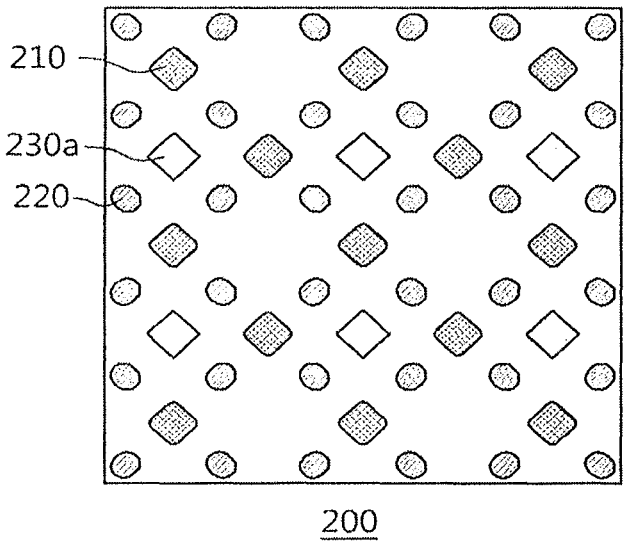
FIGS. 4 and 5 illustrate a pixel driving state in a single driving mode according to one embodiment.
Figure 5:
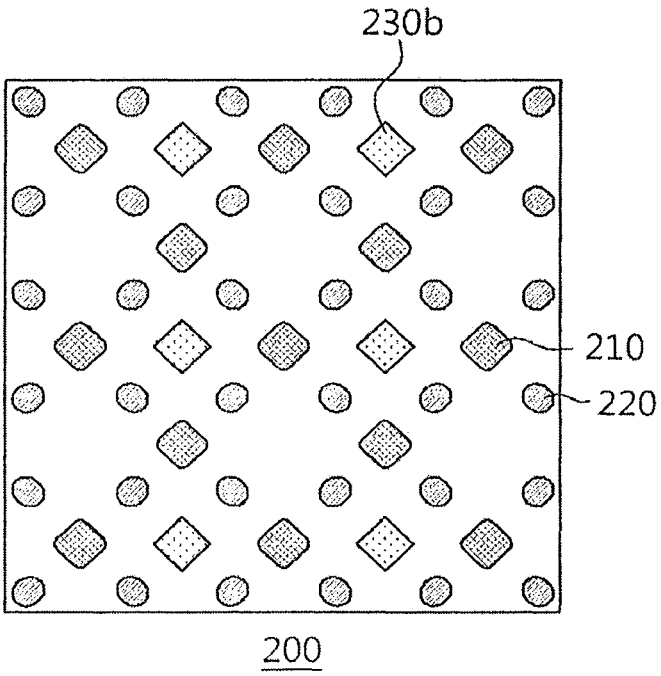

FIGS. 4 and 5 illustrate a pixel driving state of the display device 200 in a single driving mode according to one embodiment. In this embodiment, FIG. 4 illustrates the pixel driving state in a deep blue single driving mode, and FIG. 5 illustrates the pixel driving state in a sky blue single driving mode. Referring to FIG. 4, in the deep blue single driving mode, the driving unit 110 of the display device 200 controls only the deep blue pixels 230*a* of the display panel 140 to be driven, not the sky blue pixels 230*b*. Referring to FIG. 5, in the sky blue single driving mode, the driving unit 110 of the display device 200 controls only the sky blue pixels 230*b* of the display panel 140 to be driven, not the deep blue pixels 230*a*.

Figure 6:
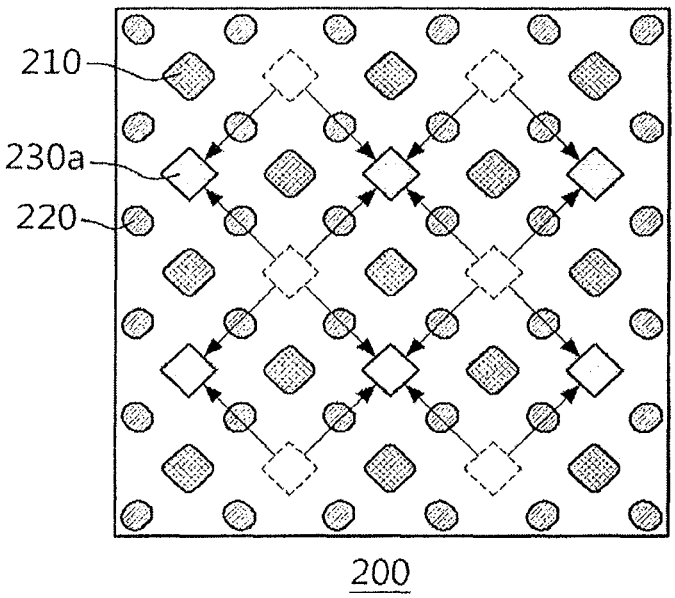
FIGS. 6 and 7 illustrate one embodiment for performing correction in a single driving mode.
Figure 7:
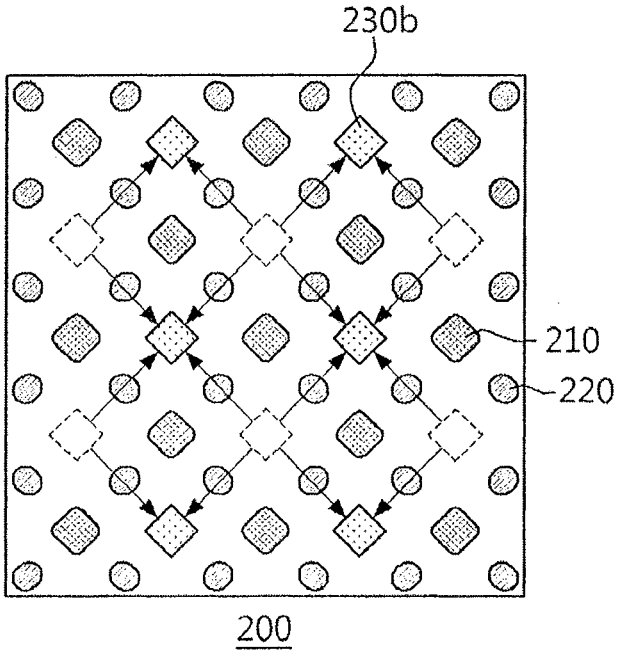

FIGS. 6 and 7 illustrate an example of correction performed in the display device 200 in the single driving mode. The correction FIG. 6 is performed in the deep blue single driving mode, and the correction in FIG. 7 is performed in the sky blue single driving mode.

Referring to FIG. 6, in the deep blue single driving mode, the driving unit 110 of the display device 200 according to the current embodiment corrects data signals for the deep blue pixels 230*a* being driven based on data signals for the sky blue pixels 230*b* not being driven. That is, corrected data of the data signals for the deep blue pixels 230*a* can be generated based on the data signals for the sky blue pixels 230*b*.

As illustrated in FIG. 6, a plurality of deep blue pixels 230*a* may be arranged adjacent to one sky blue pixel 230*b*. A data signal for each of the deep blue pixels 230*a* adjacent to the sky blue pixel 230*b* may be corrected based on a data signal for the sky blue pixel 230*b*. For example, four deep blue pixels 230*a* may be adjacent to one sky blue pixel 230*b* in diagonal directions and separated by equal distances from the sky blue pixel 230*b*, as illustrated in FIG. 6. In this case, a data signal for each of the four deep blue pixels 230*a* may be corrected based on a data signal for the sky blue pixel 230*b*.

Since the sky blue pixels 230*b* are not driven in the deep blue single driving mode, a plurality of deep blue pixels 230*a* adjacent to one sky blue pixel 230*b* may share a resolution that may be obtained by the driving the sky blue pixel 230*b*. A data signal for each of the deep blue pixels 230*a* may be corrected based on a data signal for the sky blue pixel 230*b*. As a result, a resolution similar to a resolution obtained by driving the sky blue pixel 230*b*, as well as the deep blue pixels 230*a*, may be obtained by driving only the deep blue pixels 230*a*.

In one embodiment, the data signal for each of the four deep blue pixels 230*a* may be corrected to an equal level. For example, each of the four deep blue pixels 230*a* may be responsible for a quarter of the resolution obtained by driving the sky blue pixel 230*b*.

From a different aspect, a data signal for one deep blue pixel 230*a* may be corrected based on data signals for a plurality of sky blue pixels 230*b* adjacent to the deep blue pixel 230*a*. For example, if four sky blue pixels 230*b* are adjacent to one deep blue pixel 230*a* in the diagonal directions and separated by equal distances from the deep blue pixel 230*a*, a data signal for the deep blue pixel 230*a* may be sequentially and cumulatively corrected based on a data signal for each of the four sky blue pixels 230*b*.

Referring to FIG. 7, in the sky blue single driving mode, the driving unit 110 of the display device 200 corrects the data signals for the sky blue pixels 230*b* driven based on the data signals for the deep blue pixels 230*a*, which are not being driven. Thus, corrected data of the data signals for the sky blue pixels 230*b* may be generated based on the data signals for the deep blue pixels 230*a*.

As illustrated in FIG. 7, a plurality of sky blue pixels 230*b* may be arranged adjacent to one deep blue pixel 230*a*. A data signal for each of the sky blue pixels 230*b* adjacent to the deep blue pixel 230*a* may be corrected based on a data signal for the deep blue pixel 230*a*.

The data signal for each of the sky blue pixels 230*b* may be corrected in substantially the same way as the data signal is corrected for each of the deep blue pixels 230*a* in the deep blue single driving mode. From a different aspect, the data signal for one sky blue pixel 230*b* may be corrected based on data signals for a plurality of deep blue pixels 230*a* adjacent to the sky blue pixel 230*b*. For example, if four deep blue pixels 230*a* are adjacent to one sky blue pixel 230*b* in the diagonal directions and separated by equal distances from the sky blue pixel 230*b*, the data signal for the sky blue pixel 230*b* may be sequentially and cumulatively corrected based on a data signal for each of the four deep blue pixels 230*a*.

Figure 8:
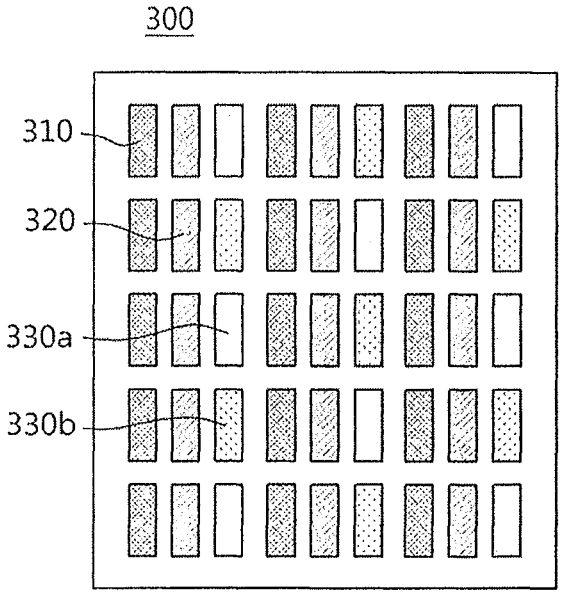
FIG. 8 illustrates another embodiment of a pixel arrangement.

FIG. 8 illustrates another embodiment of a pixel arrangement of a display device 300. Referring to FIG. 8, the display device 300 uses the unit colors of red, green, and blue, divided into deep blue and sky blue. In this case, a plurality of red pixels 310, a plurality of green pixels 320, a plurality of deep blue pixels 330*a*, and a plurality of sky blue pixels 330*b* in the display panel 140 may be arranged as in FIG. 8.

In one embodiment, a red pixel 310, a green pixel 320, a deep blue pixel 330*a*, a red pixel 310, a green pixel 320, and a sky blue pixel 330*b* may be sequentially and repeatedly arranged in each row of the display panel 140. A column of the red pixels 310, a column of the green pixels 320, and a column of blue pixels may be sequentially and repetitively arranged in the display panel 140. In the column of the blue pixels, the deep blue pixels 330*a* and the sky blue pixels 330*b* may be alternately arranged. A different arrangement of pixels may be used in another embodiment.

Figure 9:
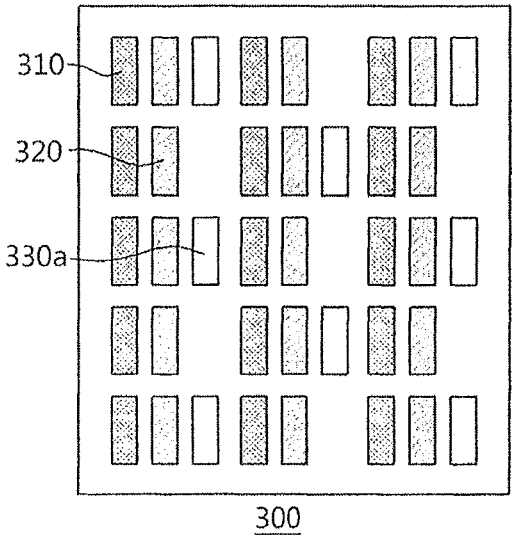
FIGS. 9 and 10 illustrate a pixel driving state in a single driving mode according to another embodiment.
Figure 10:
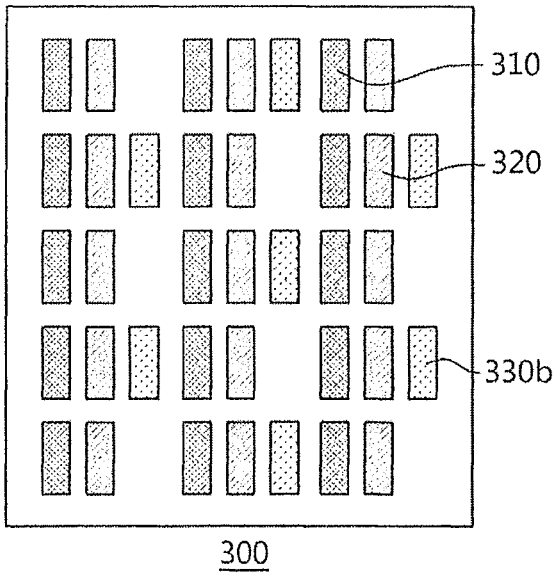

FIGS. 9 and 10 illustrate a pixel driving state of the display device 300 in a single driving mode according to one embodiment. The pixel driving state in FIG. 9 is in a deep blue single driving mode, and the pixel driving state in FIG. 10 is in a sky blue single driving mode. Referring to FIG. 9, in the deep blue single driving mode, the driving unit 110 of the display device 300 controls only the deep blue pixels 330*a* of the display panel 140 to be driven, not the sky blue pixels 330*b*. Referring to FIG. 10, in the sky blue single driving mode, the driving unit 110 of the display device 300 controls only the sky blue pixels 330*b* of the display panel 140 to be driven, not the deep blue pixels 330*a*.

Figure 11:
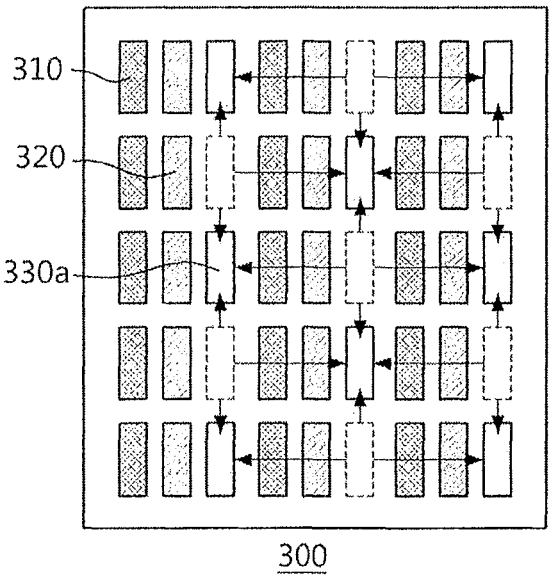
FIGS. 11 and 12 illustrate another embodiment for performing correction in a single driving mode.
Figure 12:
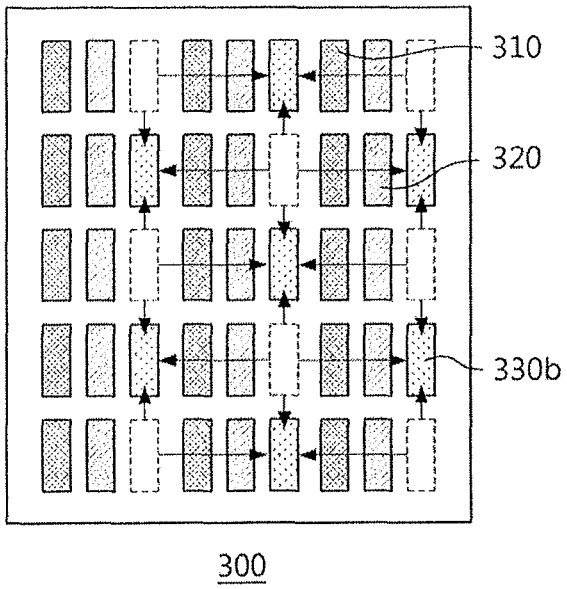

FIGS. 11 and 12 illustrate an example of correction performed in the display device 200 in the single driving mode. In FIG. 11, correction is performed in the deep blue single driving mode. In FIG. 12, correction is performed in the sky blue single driving mode.

Referring to FIG. 11, in the deep blue single driving mode, the driving unit 110 of the display device 300 according to the current embodiment corrects data signals for the deep blue pixels 330*a* being driven based on data signals for the sky blue pixels 330*b* not being driven. That is, corrected data of the data signals for the deep blue pixels 330*a* can be generated based on the data signals for the sky blue pixels 330*b*.

As illustrated in FIG. 11, a plurality of deep blue pixels 330*a* may be arranged adjacent to one sky blue pixel 330*b*. A data signal for each of the deep blue pixels 330*a* adjacent to the sky blue pixel 330*b* may be corrected based on a data signal for the sky blue pixel 330*b*. For example, four deep blue pixels 330*a* may be disposed adjacent to one sky blue pixel 330*b* in horizontal and vertical directions in FIG. 11. A data signal for each of the four deep blue pixels 330*a* may be corrected based on a data signal for the sky blue pixel 330*b*.

Since the sky blue pixels 330*b* are not driven in the deep blue single driving mode, four deep blue pixels 330*a* adjacent to one sky blue pixel 330*b* may share a resolution obtained by the driving the sky blue pixel 330*b*. A data signal for each of the deep blue pixels 330*a* may be corrected based on a data signal for the sky blue pixel 330*b*. As a result, a resolution similar to a resolution obtained by driving the sky blue pixel 330*b*, as well as the deep blue pixels 330*a*, may be obtained by driving only the deep blue pixels 330*a*.

The data signal for each of the four deep blue pixels 330*a* may be corrected to an equal level. For example, each of the four deep blue pixels 330*a* may be responsible for a quarter of the resolution obtained by driving the sky blue pixel 330*b*.

From a different aspect, the data signal for one deep blue pixel 330*a* may be corrected based on data signals for a plurality of sky blue pixels 330*b* adjacent to the deep blue pixel 330*a*. For example, if four sky blue pixels 330*b* are adjacent to one deep blue pixel 330*a* in the horizontal and vertical directions, the data signal for the deep blue pixel 330*a* may be sequentially and cumulatively corrected based on a data signal for each of the four sky blue pixels 330*b*.

Referring to FIG. 12, in the sky blue single driving mode, the driving unit 110 of the display device 300 corrects the data signals for the sky blue pixels 330*b* driven based on the data signals for the deep blue pixels 330*a*, which are not being driven. For example, corrected data of the data signals for the sky blue pixels 330*b* may be generated based on the data signals for the deep blue pixels 330*a*.

As illustrated in FIG. 12, a plurality of sky blue pixels 330*b* may be arranged adjacent to one deep blue pixel 330*a*. A data signal for each of the sky blue pixels 330*b* adjacent to the deep blue pixel 330*a* may be corrected based on a data signal for the deep blue pixel 330*a*. The data signal for each of the sky blue pixels 330*b* may be corrected in substantially the same way as the data signal for each of the deep blue pixels 330*a* is corrected in the deep blue single driving mode.

Figure 13:
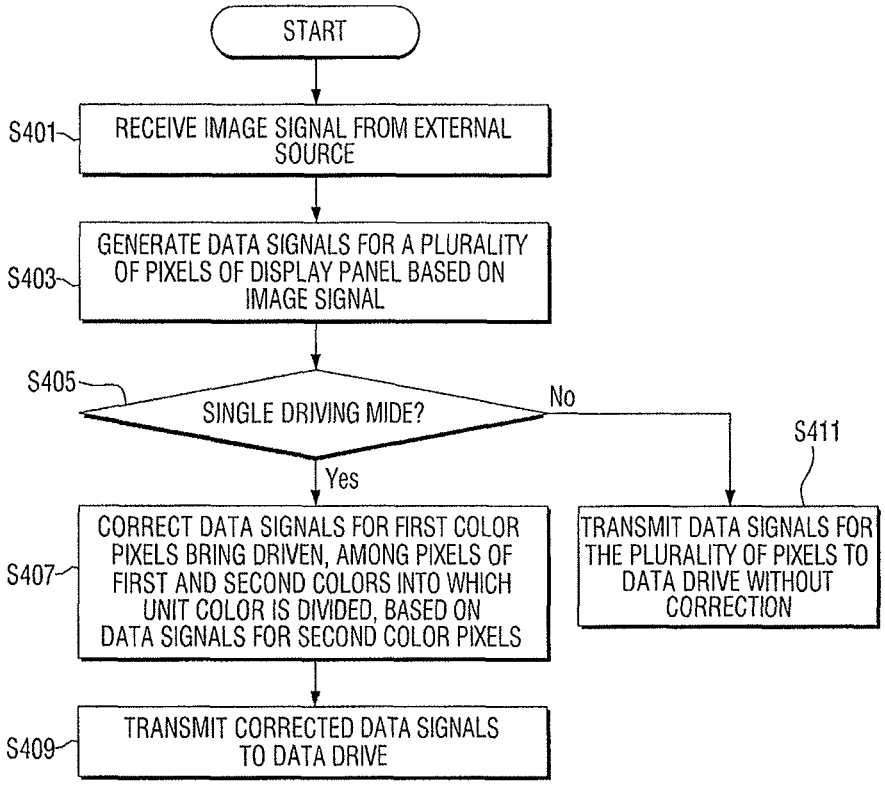
FIG. 13 illustrates an embodiment of a method for driving a display device.

FIG. 13 illustrates an embodiment of a method for driving a display device, which, for example, may be display device 100 previously discussed. Referring to FIG. 13, the method of driving the display device 100 includes a series of operations performed sequentially. First, the driving unit 110 of the display device 100 receives an image signal from an external source (operation S401). Then, the driving unit 110 generates data signals for a plurality of pixels in the display panel 140 based on the image signal (operation S403).

Next, the driving unit 110 identifies whether the display device 100 is in a single driving mode, in which any one of two colors into which a unit color is divided is driven (operation S405). In the current embodiment, operation S405 is performed after operation S403. In another embodiment, operation S405 may be performed before operations S401 and S403.

The display device 100 may be operated in a mixed driving mode or single driving mode. The driving mode of the display device 100 may be set, for example, by a user or may be automatically set or modified according to a preset condition.

If it is identified, in operation S405, that the display device 100 is in the single driving mode, data signals for pixels being driven among pixels of two colors (into which a unit color is divided) are corrected based on data signals for pixels not being driven (operation S407). This correction may be performed to change gray information in each of the data signals for the pixels being driven. In correcting the data signals (operation S407), the driving unit 110 of the display device 100 may correct the data signals for the pixels being driven based on a luminance ratio of the two colors of the unit color.

For example, the driving unit 110 may correct gray information in each of the data signals in view of the luminance ratio of the two colors of the unit color. For more accurate correction, the driving unit 110 may correct the gray information in each of the data signals in further view of luminance according to the gray value of each of the two colors of the unit color.

The gray information may be corrected in view of the luminance ratio of the two colors of the unit color, for example, in the following manner. To correct a data signal for a first color pixel being driven among pixels of a first color and a second color, into which a unit color is divided based on a data signal for a second color pixel not being driven, correction of the data signals (operation S407) may include calculating a luminance change value of the second color pixel, calculating a corrected gray value of the first color pixel based on the luminance change value of the second color pixel, and correcting the data signal for the first color pixel based on the corrected gray value of the first color pixel. In correcting of the data signal for the first color pixel, a corrected data signal of the data signal for the first color pixel may be generated based on the corrected gray value of the first color pixel.

In one embodiment, the luminance change value of the second color pixel may be calculated based on Equation 1 and the corrected gray value of the first color pixel may be calculated based on Equation 2.

$$\text{Luminance change value of second color pixel} = (\text{gray value of second color pixel}/255)^{G} \times (\text{maximum luminance of second color pixel}) \times (\text{luminance of first color}/\text{luminance of second color}) \approx (\text{number of first color pixels to be corrected}) \quad \text{Equation 1}$$

$$\text{Corrected gray value of first color pixel} = (\text{gray value of first color pixel}) + (\text{luminance change value of second color pixel})^{1/G} \times 255 \quad \text{Equation 2}$$

In one embodiment, the number of first color pixels to be corrected may be the number of first color pixels adjacent to the second color pixel and corrected based on the data signal for the second color pixel. For example, the number of first color pixels to be corrected may be four in FIGS. 6, 7, 11, and 12. In Equations 1 and 2, G indicates a gamma coefficient and may be preset to an appropriate value in view of image signal perception characteristics according to gray value. G may be, for example, 2.2 or another value.

The gray value of the first color pixel and the gray value of the second color pixel may be obtained from the data signal for the first color pixel and the data signal for the second color pixel, respectively. Gray information in the data signal for the first color pixel may be corrected based on the corrected gray value of the first color pixel.

In Equation 1, (luminance of first color/luminance of second color) indicates a luminance ratio of two colors into which a unit pixel is divided. For example, a first color of a unit color may be deep blue and a second color of the unit color may be sky blue. In this case, since the luminance of sky blue is approximately five times the luminance of deep blue, (luminance of first color/luminance of second color) may be approximately 1/5.

Next, the gray information may be corrected in further view of luminance according to the gray value of each of the two colors of the unit color as follows.

To correct a data signal for a first color pixel being driven among pixels of two colors, into which a unit color is divided based on a data signal for a second color pixel not being driven, the correcting of the data signals (operation S407) may include calculating a luminance change value of the second color pixel, calculating a luminance change value of the first color pixel, calculating a corrected gray value of the first color pixel based on the luminance change value of the second color pixel and the luminance change value of the first color pixel, and correcting the data signal for the first color pixel based on the corrected gray value of the first color pixel. In correcting of the data signal for the first color pixel, corrected data of the data signal for the first color pixel may be generated based on the corrected gray value of the first color pixel.

The luminance change value of the second color pixel may be calculated based on Equation 1, the luminance change value of the first color pixel may be calculated based on Equation 3, and the corrected gray value of the first color pixel may be calculated based on Equation 4.

$$\text{Luminance change value of first color pixel} = (\text{gray value of first color pixel}/255)^{G} \times (\text{maximum luminance of first color pixel}) \quad \text{Equation 3}$$

$$\text{Corrected gray value of first color pixel} = (\text{luminance change value of first color pixel}) + (\text{luminance change value of second color pixel})^{1/G} \times 255 \quad \text{Equation 4}$$

For rapid correction, a storage unit 118 of the display device 100 may calculate, in advance, a luminance change value according to a gray value of each of two colors into which a unit color is divided and store the luminance change values in the form of a table.

For example, the storage unit 118 may calculate a luminance change value according to a change in gray value based on a pre-identified luminance ratio of two colors into which a unit color is divided, maximum luminance of each of the two colors and the number of pixels to be corrected, and may store the luminance change values in the form of a table. Therefore, the above correction process may be performed rapidly by extracting a luminance change value corresponding to a gray value from the table.

After correcting of the data signals (operation S407), the corrected data signals are transmitted to a data drive 120 (operation S409). The data drive 120 outputs gray voltages for respective driving data lines connected to the pixels based on the corrected data signals. If it is identified, in operation S405, that the display device 100 is in a mixed driving mode, not the single driving mode, the driving unit 110 may transmit the data signals to the data drive 120 without correction (operation S411).

In one embodiment, at least the signal correction unit of the driving unit 110 may be implemented in logic to perform the operations previously identified. For example, the signal corrector may include first logic to generate corrected data of the data signal for the first color pixel based on the data signal for the second color pixel in a single driving mode.

In this or another embodiment, the driving circuit may include first logic to receive an image signal, second logic to generate a data signal for each of a first color pixel and a second color pixel based on the image signal, and third logic to generate corrected data of the data signal for the first color pixel based on the data signal for the second color pixel in a single driving mode, wherein a unit color is divided into the first color and the second color and wherein the first color is driven and the second color is not driven. The logic may be implemented in hardware (e.g., a combination of logic, processing, computer, or other circuitry for performing the operations of the embodiments of the display device and methods), software, or both, and may perform all or any portion of the operations set forth, for example, in FIG. 13.

In another embodiment, a non-transitory computer-readable medium stores instructions for causing a processor, controller, logic, computer, or other computing device to perform the operations of the display device and/or method embodiments disclosed herein.

In accordance with one or more of the aforementioned embodiments, a display device and a method of driving the same compensates for a reduction in resolution that occurs when the number of pixels being driven is limited in a single driving mode, in which any one of a plurality of colors into which a unit color is divided is used, wherein at least one of the color pixels (e.g., a first color pixel) is divided into pixels of a plurality of colors (e.g., two, three, or more) for driving in single driving mode. Therefore, the single driving mode with compensation may relatively improve display quality compared with a single driving mode without compensation.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display device, comprising:

a first pixel group including a first pixel, a second pixel, a third pixel and a fourth pixel;

a second pixel group adjacent to the first pixel group in a first direction, the second pixel group including a fifth pixel, a sixth pixel, a seventh pixel and a eighth pixel;

wherein the first pixel, the second pixel, the fifth pixel and the sixth pixel are configured to emit light of a first unit color, wherein the fourth pixel and the seventh pixel are configured to emit light of a second unit color which is different from the first unit color, wherein the third pixel and the eighth pixel are configured to emit light of a third unit color which is different from the first unit color and the second unit color, wherein the third pixel is to emit light having a first center wavelength, and the eighth pixel is to emit light having a second center wavelength different from the first center wavelength.

2. The display device as claimed in claim 1, wherein:

the third pixel is adjacent to the fourth pixel in a second direction perpendicular to the first direction, and the seventh pixel is adjacent to the eighth pixel in the second direction.

3. The display device as claimed in claim 2, wherein:

the third pixel is adjacent to the seventh pixel in the first direction, and the fourth pixel is adjacent to the eighth pixel in the first direction.

4. The display device as claimed in claim 3, wherein the fifth pixel is disposed between the third pixel and the eighth pixel in a third direction crossing the first direction and the second direction.

5. The display device as claimed in claim 4, wherein the fifth pixel is disposed between the fourth pixel and the seventh pixel in a fourth direction crossing the first direction, the second direction, and the third direction.

6. The display device as claimed in claim 2, wherein a distance between the third pixel and the fourth pixel, a distance between the third pixel and the seventh pixel, a distance between the seventh pixel and the eighth pixel, and a distance between the eighth pixel and the fourth pixel are substantially the same.

7. The display device as claimed in claim 2, wherein the third unit color is blue.

8. The display device as claimed in claim 7, wherein:

the first center wavelength is in a range of 440 nm to 458 nm, and the second center wavelength is in a range of 459 nm to 480 nm.

9. The display device as claimed in claim 7, wherein:

the second center wavelength is in a range of 440 nm to 458 nm, and the first center wavelength is in a range of 459 nm to 480 nm.

10. The display device as claimed in claim 7, wherein:

the first unit color is green, and the second unit color is red.

11. The display device as claimed in claim 1, wherein the third pixel is to be driven based on a data signal for the eighth pixel in a single driving mode and the eighth pixel is not to be driven in the single driving mode.

12. The display device as claimed in claim 11, further comprising a signal receiver to receive an image signal;

a signal generator to generate a data signal for the third pixel and the data signal for the eighth pixel based on the image signal; and a signal corrector to generate corrected data for the third pixel based on the data signal for the eighth pixel in the single driving mode.

13. The display device as claimed in claim 12, wherein:

the signal corrector is to:

calculate a luminance change value of the eighth pixel, calculate a corrected gray value of the fourth pixel based on the luminance change value of the eighth pixel, and generate the corrected data based on the corrected gray value of the fourth pixel.

14. The display device as claimed in claim 12, wherein:

the signal corrector is to:

calculate a luminance change value of the fourth pixel and a luminance change value of the eighth pixel, calculate a corrected gray value of the fourth pixel based on the luminance change value of the fourth pixel and the luminance change value of the eighth pixel, and generate the corrected data based on the corrected gray value of the fourth pixel.

15. A display device, comprising:

a first pixel group including a first pixel, a second pixel, and a third pixel;

a second pixel group adjacent to the first pixel group in a first direction, the second pixel group including a fourth pixel, a fifth pixel and a sixth pixel;

wherein the first pixel and the fourth pixel are configured to emit light of a first unit color, wherein the second pixel and the fifth pixel are configured to emit light of a second unit color which is different from the first unit color, wherein the third pixel and the sixth pixel are configured to emit light of a third unit color which is different from the first unit color and the second unit color, wherein the third pixel is to emit light having a first center wavelength, and the sixth pixel is to emit light having a second center wavelength different from the first center wavelength.

16. The display device as claimed in claim 15, wherein:

the first pixel, the second pixel and the third pixel are sequentially arranged in a second direction crossing the first direction, and the fourth pixel, the fifth pixel and the sixth pixel are sequentially arranged in the second direction.

17. The display device as claimed in claim 16, wherein the third pixel is adjacent to the sixth pixel in the first direction.

18. The display device as claimed in claim 15, wherein the third unit color is blue.

19. The display device as claimed in claim 18, wherein:

the first center wavelength is in a range of 440 nm to 458 nm, and the second center wavelength is in a range of 459 nm to 480 nm.

20. The display device as claimed in claim 18, wherein:

the second center wavelength is in a range of 440 nm to 458 nm, and the first center wavelength is in a range of 459 nm to 480 nm.

21. The display device as claimed in claim 18, wherein:

the first unit color is red, and the second unit color is green.

22. The display device as claimed in claim 15, wherein the third pixel is to be driven based on a data signal for the sixth pixel in a single driving mode and the six pixel is not to be driven in the single driving mode.

23. The display device as claimed in claim 22, further comprising a signal receiver to receive an image signal;

a signal generator to generate a data signal for the third pixel and the data signal for the sixth pixel based on the image signal; and a signal corrector to generate corrected data for the third pixel based on the data signal for the sixth pixel in the single driving mode.

24. A display device, comprising:

a signal receiver to receive an image signal;

a signal generator to generate a data signal for each of a first pixel and a second pixel based on the image signal; and a signal corrector to generate corrected data for the first pixel based on the data signal for the second pixel in a single driving mode, wherein the first pixel and the second pixel are to emit light of a same unit color, wherein the first pixel is to emit light having a first center wavelength and the second pixel is to emit light having a second center wavelength different from the first center wavelength, and wherein the first pixel is to be driven and the color pixel is not to be driven in the single driving mode.

25. The display device as claimed in claim 24, wherein the signal corrector is to:

calculate a luminance change value of the second pixel, calculate a corrected gray value of the first pixel based on the luminance change value of the second pixel, and generate the corrected data based on the corrected gray value of the first pixel.

26. The display device as claimed in claim 24, wherein the signal corrector is to:

calculate a luminance change value of the first pixel and a luminance change value of the second pixel, calculate a corrected gray value of the first pixel based on the luminance change value of the color pixel and the luminance change value of the second pixel, and generate the corrected data based on the corrected gray value of the first pixel.

27. The display device as claimed in claim 24, wherein:

the same unit color is blue.

28. The display device as claimed in claim 24, wherein:

the first center wavelength is in a range of 440 to 458 nm, and the second center wavelength is in a range of 459 to 480 nm.

29. The display device as claimed in claim 24, wherein:

the second center wavelength is in a range of 440 to 458 nm, and the first center wavelength is in a range of 459 to 480 nm.

30. A display device, comprising:

a first pixel group including a first pixel, a second pixel, a third pixel and a fourth pixel;

a second pixel group adjacent to the first pixel group in a first direction, the second pixel group including a fifth pixel, a sixth pixel, a seventh pixel and a eighth pixel;

wherein the first pixel, the third pixel, the fifth pixel and the seventh pixel are configured to emit light of a first unit color, wherein the second pixel and the sixth pixel are configured to emit light of a second unit color which is different from the first unit color, wherein the fourth pixel and the eighth pixel are configured to emit light of a third unit color which is different from the first unit color and the second unit color, wherein the first pixel and the seventh pixel are to emit light having a first center wavelength, and the third pixel and the fifth pixel are to emit light having a second center wavelength different from the first center wavelength.

31. The display device as claimed in claim 30, wherein the first pixel and the seventh pixel are to be driven based on a data signal for the eighth pixel in a single driving mode, and the third pixel and the fifth pixel are not to be driven in the single driving mode.

32. The display device as claimed in claim 30, wherein:

the fourth pixel and the eighth pixel are not directly adjacent to each other in the first direction.

33. The display device as claimed in claim 30, wherein:

the second pixel and the sixth pixel are not directly adjacent to each other in the first direction.

* * * * *